US010449555B2

(12) United States Patent
Carr

(10) Patent No.: US 10,449,555 B2
(45) Date of Patent: Oct. 22, 2019

(54) CENTRIFUGAL SEPARATOR WITH ANNULAR PISTON FOR SOLIDS EXTRUSION

(71) Applicant: Robert Bret Carr, Durham, NC (US)

(72) Inventor: Robert Bret Carr, Durham, NC (US)

( * ) Notice: Subject to any disclaimer, the term of this patent is extended or adjusted under 35 U.S.C. 154(b) by 0 days.

(21) Appl. No.: 15/976,174

(22) Filed: May 10, 2018

(65) Prior Publication Data

US 2018/0333729 A1 Nov. 22, 2018

Related U.S. Application Data

(60) Provisional application No. 62/506,723, filed on May 16, 2017.

(51) Int. Cl.

| | |
|---|---|
| ***B04B 11/05*** | (2006.01) |
| ***B04B 1/02*** | (2006.01) |
| ***B04B 11/08*** | (2006.01) |
| ***B04B 11/06*** | (2006.01) |
| ***B04B 9/12*** | (2006.01) |
| *B04B 5/04* | (2006.01) |

(52) U.S. Cl.

CPC ..... *B04B 11/05* (2013.01); *B04B 1/02* (2013.01); *B04B 9/12* (2013.01); *B04B 11/06* (2013.01); *B04B 11/08* (2013.01); *B04B 2005/0485* (2013.01)

(58) Field of Classification Search

CPC ..... B04B 11/05; B04B 11/06; B04B 9/12; B04B 1/02; B04B 11/08; B04B 2005/0485

USPC ..... 494/50, 64; 210/376

See application file for complete search history.

(56) References Cited

U.S. PATENT DOCUMENTS

| | | | | |
|---|---|---|---|---|
| 3,972,514 | A * | 8/1976 | Voitsekhovsky | C22C 9/02 266/204 |
| 6,616,590 | B2 * | 9/2003 | Kessler | B04B 1/00 494/65 |
| 6,632,166 | B2 * | 10/2003 | Carr | B04B 9/08 210/376 |
| 6,733,433 | B1 * | 5/2004 | Fell | A61M 1/3693 435/2 |
| 6,776,752 | B2 * | 8/2004 | Carr | B04B 1/02 210/376 |

(Continued)

FOREIGN PATENT DOCUMENTS

| | | | | |
|---|---|---|---|---|
| WO | WO-9715399 | A1 * | 5/1997 | A61M 1/3693 |

*Primary Examiner* — Charles Cooley
(74) *Attorney, Agent, or Firm* — Lathrop Gage LLP

(57) ABSTRACT

A centrifugal separator includes a cylindrical bowl, a core tube assembly, and an annular piston disposed around the core tube assembly and inside the inner surface of the bowl. Feed liquid is injected down the core tube assembly into the lower portion of the bowl, raising the annular piston. During a separation mode, the bowl rotates at high speed, separating solids from the feed liquid to accumulate along the inner surface of the bowl, while collecting clarified centrate as it exits the top of the bowl and through the core tube assembly. Following solids accumulation, bowl rotation is stopped and residual liquid is pumped from the bowl. In a solids discharge mode, the annular piston is urged downward along a vertical axis in response to compressed gas. The downward movement of the piston forces accumulated solids from the bowl via an opening in the lower end thereof.

14 Claims, 9 Drawing Sheets

(56) References Cited

U.S. PATENT DOCUMENTS 6,800,053 B2 * 10/2004 Fox ..... A61L 2/24 422/26
6,986,734 B2 * 1/2006 Carr ..... B04B 1/02 210/376
7,052,451 B2 * 5/2006 Carr ..... B04B 11/05 210/376
7,261,683 B2 * 8/2007 Carr ..... B04B 11/05 210/376
7,618,361 B2 * 11/2009 Carr ..... B04B 11/05 210/376
7,628,749 B2 * 12/2009 Carr ..... B01D 21/0012 210/376
7,935,042 B2 * 5/2011 Carr ..... B04B 11/05 210/376
7,998,052 B2 * 8/2011 Chammas ..... B04B 5/0442 494/26
8,475,352 B2 * 7/2013 Carr ..... B04B 7/12 494/45
2002/0016243 A1 * 2/2002 Carr ..... B04B 9/08 494/37
2003/0195105 A1 * 10/2003 Carr ..... B04B 1/02 494/38
2005/0009681 A1 * 1/2005 Carr ..... B04B 1/02 494/46
2005/0233882 A1 * 10/2005 Carr ..... B04B 11/05 494/50
2005/0233883 A1 * 10/2005 Carr ..... B04B 11/05 494/50
2007/0049479 A1 * 3/2007 Carr ..... B04B 11/05 494/23
2007/0114161 A1 * 5/2007 Carr ..... B01D 21/0012 210/96.2
2010/0029457 A1 * 2/2010 Carr ..... B04B 11/05 494/8
2010/0167899 A1 * 7/2010 Carr ..... B04B 7/12 494/4
2016/0175854 A1 * 6/2016 Carr ..... B04B 5/0442 494/37
2018/0333729 A1 * 11/2018 Carr ..... B04B 11/05

* cited by examiner

CENTRIFUGAL SEPARATOR WITH ANNULAR PISTON FOR SOLIDS EXTRUSION

CROSS-REFERENCE TO RELATED APPLICATIONS

This application claims the benefit of priority to U.S. Patent Application No. 62/506,723, filed on May 16, 2017, the entire disclosure of which is incorporated herein by reference.

FIELD

The instant disclosure relates to centrifuges, and in particular to a centrifuge enabling automatic discharge of solids that accumulate during separation.

BACKGROUND

Many different types of centrifugal separators are known for separating heterogeneous mixtures into components based on specific gravity. A heterogeneous mixture, which may also be referred to as feed material or feed liquid, is injected into a rotating bowl of the separator. The bowl rotates at high speeds and forces particles of the mixture, having a higher specific gravity, to separate from the liquid by sedimentation. As a result, a dense solids cake compresses tightly against the surface of the bowl, and the clarified liquid, or "centrate", forms radially inward from the solids cake. The bowl may rotate at speeds sufficient to produce forces 20,000 times greater than gravity to separate the solids from the centrate.

The solids accumulate along the wall of the bowl, and the centrate is drained off. Once it is determined that a desired amount of the solids has been accumulated, the separator is placed in a discharge mode. In one such discharge mode, a scraper blade extending the length of the rotating bowl is placed in a scraping position against the separator wall and the bowl is rotated at a low scraping speed. Then, a radial-motion scraper scrapes the solids from the sides of the bowl, and they fall toward a solids collecting outlet. However, such a radial-motion scraper does not effectively remove wet or sticky solids which may have a consistency like that of peanut butter. In such instances, the sticky solids remain stuck on the scraper blades or fall from the wall and then reattach to the blades before reaching the collecting outlet. As a result, the solids recovery yield is reduced and the remaining solids undesirably contaminate the separator.

Still, other separators do not provide a convenient means by which to handle and recover sensitive solids, such as proteins. For example, an operator is commonly used to assist with solids discharge and recovery, using a complicated and costly solids discharge valve. Separators that require such operator intervention often suffer from contamination problems. Furthermore, some separators employ numerous mechanical components to facilitate solids recovery, which can affect separator durability. Such components are usually external to the separator or in the form of add-on equipment that poses both size and compatibility issues. Conventional separators also tend to be difficult to clean or sterilize without significantly increasing maintenance costs.

Sensitive solids may also suffer from degradation during the centrifugation process, thus reducing the usable yield following centrifugation. For example, foam may be generated at any air interface where feed liquid is added to a separator bowl, increasing fluid shear and causing product degradation. Further, exposure to air at the liquid/air interface can increase product oxidation in bio-pharmaceutical fluids.

It is desirable to have a centrifugal separator that can be effectively used with solids that result in sticky accumulations and/or are sensitive to shear forces generated during centrifugation, thereby recovering a higher amount of solids from the centrate. Such solids (e.g. proteins) would have a lower level of degradation and/or oxidation, and thus a higher level of activity. It would also be useful to have a separator that can easily recover such solids without the possibility of external contamination or additional mechanical equipment. Such a separator should also be able to be conveniently cleaned or sterilized-in-place.

SUMMARY OF THE DISCLOSURE

The present disclosure provides a centrifugal separator for separating sticky solids from a feed liquid and discharging the accumulated solids. In one aspect, the centrifugal separator includes a separator housing having a main body portion. A cylindrical separator bowl is disposed in the main body portion of the separator housing, and has an upper end, and a lower end with an opening. Solids accumulated from a feed liquid are discharged through the opening into a reservoir or tank, for later use or resuspension in a buffer liquid. The cylindrical separator bowl is operative during a separation mode of operation to rotate at a high speed to separate feed liquid into centrate and solids. The solids accumulate along an inner surface of the cylindrical separator bowl.

The centrifugal separator also includes a core tube assembly disposed axially along the interior length of the cylindrical separator bowl. The core tube assembly includes a pull rod operative for axial movement along the core tube assembly, as well as a shuttle valve operatively coupled to the pull rod. The shuttle valve is operative for axial movement within the opening in the lower end of the cylindrical separator feed bowl to open and close the opening. An actuator is disposed at the upper end of the core tube assembly. The actuator is operatively coupled to the pull rod to move the shuttle valve into and out of the opening.

The centrifugal separator further includes an annular piston disposed between an inner surface of the cylindrical separator bowl and an outer surface of the core tube assembly. The annular piston is in a tight-fitting relationship with both the inner surface of the cylindrical separator bowl and the outer surface of the core tube assembly so as to allow the annular piston to move in response to gas pressure, as well as to efficiently extrude accumulated solids from the cylindrical separator bowl. The annular piston is operative for axial movement to discharge solids out of the opening in the lower end of the cylindrical separator bowl.

The centrifugal separator also includes a gas port in gas communication with an upper surface of the annular piston via at least one gas passage in the upper end of the cylindrical separator bowl. Gas is introduced through the gas port, and presses against the upper surface of the annular piston to drive the annular piston downward and discharge solids through the opening in the lower end of the cylindrical separator bowl.

In some embodiments, the core tube assembly comprises a feed tube along an interior length of the core tube assembly. The feed tube is in liquid communication with the cylindrical separator bowl when the shuttle valve has closed the opening in the lower end of the cylindrical separator bowl. In some embodiments, the feed tube is in liquid communication with the cylindrical separator bowl via at least one feed acceleration channel disposed in the shuttle valve.

In some embodiments, the shuttle valve comprises at least one slot disposed in a lower portion of the shuttle valve. In such embodiments, solids may be extruded out of the cylindrical separator bowl through the at least one slot by the annular piston when the lower portion of the shuttle valve is moved within the opening in the lower end of the cylindrical separator bowl. In such embodiments, the shuttle valve closes the opening by moving within the opening and blocking the at least one slot in the shuttle valve with the inner surface of the opening. The shuttle valve opens the opening by moving within the opening and exposing the at least one slot.

In some embodiments, the lower end of the core tube assembly includes at least one slot, such that solids are extruded through the at least one slot. In such embodiments, the shuttle valve closes the opening by moving within the opening and blocking the at least one slot. The shuttle valve opens the opening by moving within the opening and exposing the at least one slot.

In some embodiments, the core tube assembly comprises at least one spring disposed between the shuttle valve and a lower portion of the core tube assembly. The at least one spring forces the shuttle valve into the opening in the lower end of the centrifugal separator bowl to close the opening.

In some embodiments the annular piston comprises at least one magnet, and the separator housing comprises an array of magnetic switches for detecting the position of the annular piston through selective interaction with the at least one annular piston magnet.

In some embodiments, the core tube assembly includes an opening in liquid communication with a centrate passage. The centrate passage is defined by an inner surface of the core tube assembly and an outer surface of the feed tube, and is in fluid communication with a centrate port, thereby allowing removal of centrate from the centrifugal separator bowl.

In some embodiments, the centrifugal separator also includes an isolation valve disposed proximate a passage defined by an inner surface of the separator housing and an outer surface of the cylindrical separator bowl. The isolation valve opens and closes the passage defined the inner surface of the separator housing and the outer surface of the cylindrical separator bowl. In some embodiments, the centrifugal separator includes a discharge case having a gas holding area in gas communication with the gas passage. When the isolation valve is closed, a gas-tight seal is formed and gas pressure from the gas port, through the discharge case and the gas passage may be used to force the annular piston down the centrifugal separator bowl.

In some embodiments, the lower end of the cylindrical separator bowl and a lower portion of the annular piston are complementarily shaped. For example, the lower end of the cylindrical separator bowl and the lower portion of the annular piston may be substantially frustoconically shaped.

In another aspect, the disclosure provides a method for discharging solids from a centrifugal separator. The method includes providing a centrifugal separator. The centrifugal separator includes a separator housing having a main body portion, and a cylindrical separator bowl disposed in the main body portion of the separator housing. The cylindrical separator bowl includes an upper end, and a lower end with an opening. The centrifugal separator includes a core tube assembly disposed axially along the interior length of the cylindrical separator bowl. The core tube assembly also includes a pull rod operative for axial movement along the core tube assembly, and a shuttle valve operatively coupled to the pull rod. The shuttle valve is operative for axial movement to open and close the opening in the lower end of the cylindrical separator bowl. The centrifugal separator includes an actuator at the upper end of the core tube assembly. The actuator is operatively coupled to the pull rod to move the shuttle valve into and out of the opening. An annular piston is disposed between an inner surface of the cylindrical separator bowl and an outer surface of the core tube assembly, and is operative for axial movement to discharge solids out of the opening in the lower end of the cylindrical separator bowl. A gas port is also include, which is in gas communication with an upper surface of the annular piston via at least one gas passage in the upper end of the separator bowl. The method includes introducing gas through the gas port to press against the upper surface of the annular piston to drive the annular piston downward and discharge solids through the opening in the lower end of the cylindrical separator bowl.

In some embodiments, the method includes closing an isolation valve before introducing gas through the gas port. The isolation valve is disposed proximate a passage defined by an inner surface of the separator housing and an outer surface of the cylindrical separator bowl.

In some embodiments, the method includes opening the shuttle valve before introducing gas through the gas port. Opening the shuttle valve is accomplished by actuating the actuator to move the shuttle valve in the opening to expose the opening in the lower end of the cylindrical separator bowl. In some embodiments, the at least one slot is disposed in a lower portion of the shuttle valve. In some embodiments, the at least one slot is disposed in the core tube assembly.

In some embodiments, the method includes closing the shuttle valve after the annular piston has reached the bottom of the cylindrical separator bowl. Closing the shuttle valve is accomplished by activating the actuator to move the shuttle valve within the opening, thereby covering the at least one slot.

In some embodiments, the method includes injecting feed liquid into the cylindrical separator bowl through a feed tube in the core tube assembly prior to introducing gas through the gas port. In some embodiments, feed liquid injected into the cylindrical separator bowl passes through at least one feed acceleration channel disposed in the shuttle valve.

In some embodiments, the method includes rotating the cylindrical separator bowl at a high speed to separate feed liquid into centrate and solids. Solids accumulate along an inner surface of the cylindrical separator bowl.

In some embodiments, the core tube assembly comprises an opening in liquid communication with a centrate passage. The centrate passage is defined by an inner surface of the core tube assembly and an outer surface of the feed tube, and is in fluid communication with a centrate port. This allows removal of centrate from the centrifugal separator bowl. In some embodiments, the inner surface of the core tube assembly comprises a centrate tube.

DETAILED DESCRIPTION OF THE DISCLOSURE

As described below and shown in the accompanying drawings, the centrifugal separator described herein includes a cylindrical separator bowl and an annular piston surrounding a core tube assembly for introducing a feed liquid, removing centrate, and a shuttle valve for extruding accumulated solids following centrifugation. Unlike centrifugal separators with a central piston assembly, centrifugal separators using the technology described herein can accommodate more solids, thus allowing processing of feed liquids having a higher percentage of solids by volume. The use of a central core tube to feed liquid also prevents wave agitation of the feed liquid during separation and increasing the efficiency of solids separation. The use of a core tube to feed liquid also results in dryer solids having lower moisture content and a clearer centrate having a lower suspended solids content that is removed during centrifugation. Further, foaming and oxidation of feed liquid is reduced during introduction of feed liquid into the lower end of the bowl while contacting and raising the annular piston.

The annular piston is simple and does not require any springs, O-rings, or internal valves. Further, solids discharge may be accomplished using a shuttle valve associated with the core tube assembly that can be automatically activated without operator intervention. The centrifugal separator described herein has a reduced overall parts count and reduced component complexity, resulting in a lower associated cost and increased ease of maintenance, compared to other centrifugal separators.

Figure 1:
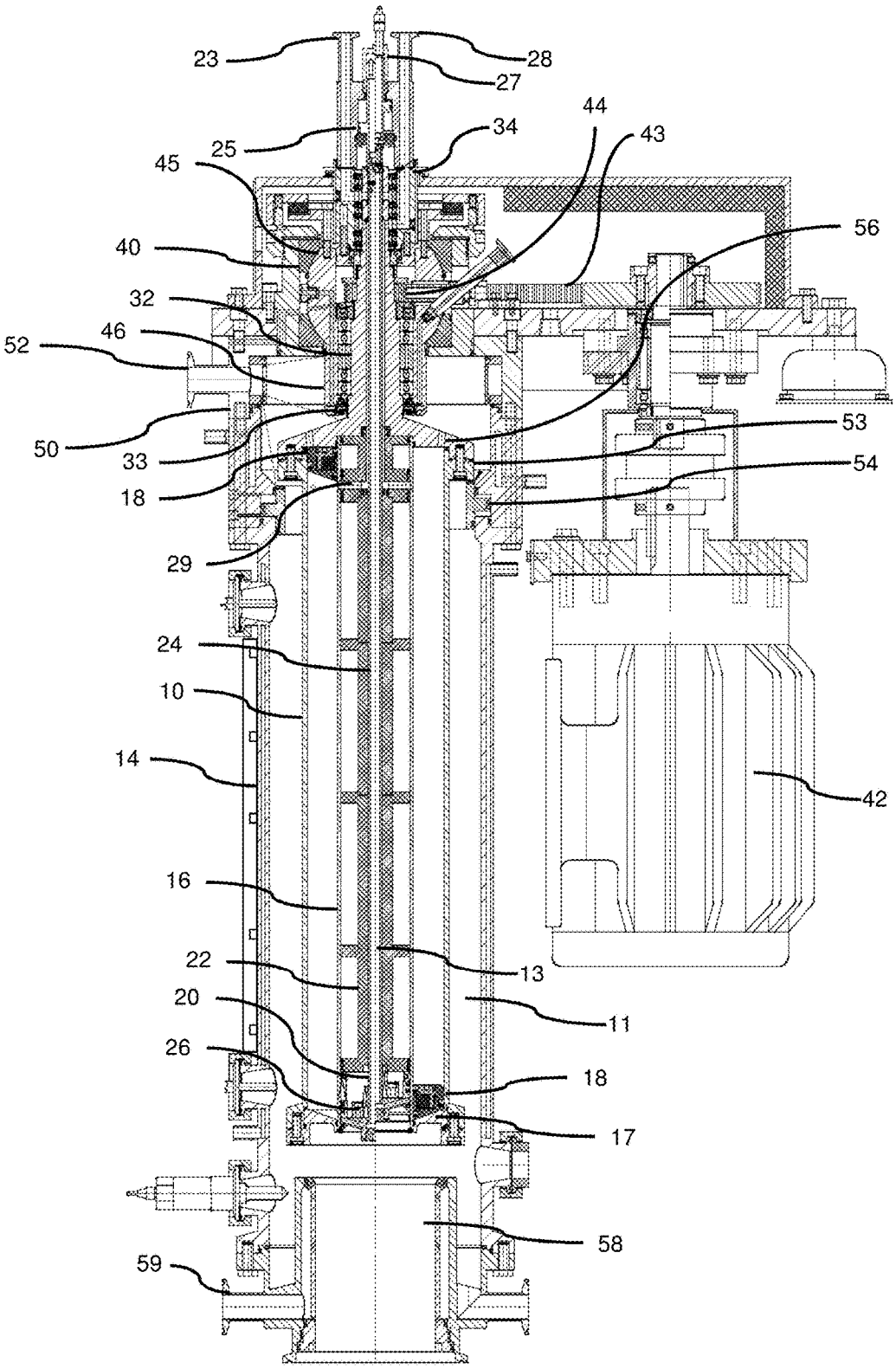
FIG. 1 is a partial section view of a centrifugal separator of the disclosure.

FIG. 1 shows a centrifugal separator in vertical section. The centrifugal separator includes a cylindrical separator bowl 10 mounted in a central region 11 of a separator housing 14. The cylindrical separator bowl 10 rotates around a central vertical axis 13. By having the length of the bowl longer than its diameter, "end effects" in the bowl can be minimized with respect to the bowl's internal volume. In general, end effects can be caused by fluid eddies along any of the angled portions within the interior of the bowl and, particularly, near the ends thereof. In one embodiment, the separator bowl 10 can be a cylindrical type bowl having a relatively small diameter D and a length L such that the ratio of LID is approximately 5/1 or greater. Such a ratio of L/D tends to prevent axial waves from developing within the bowl as such waves substantially dissipate as they travel the length of the bowl. By employing an L/D ratio of approximately 5/1 or greater, a separator of the invention can also avoid the need for baffles within the bowl, which are used in conventional separators to minimize axial waves.

The separator in FIG. 1 includes a core tube assembly 16 for moving feed liquid into the separator bowl 10 and clarified centrate out of the separator bowl 10, as well as an annular solids discharge piston 18 for extruding accumulating solids out of the separator bowl 10. As shown, the annular piston 18 can have a lower conical portion that matches the shape of a lower conical end 17 of the separator bowl 10. The conical lower end 17 acts as a rotational accelerator of the feed liquid during a feed mode of operation for the separator.

Mounted in the separator bowl 10 is a core tube assembly 16. Core tube assembly 16 includes a pull rod 20 inside a pull rod support 22. A feed liquid port 23 above the separator housing 14 is in communication with a feed tube 24 inside of pull rod 20 (see FIGS. 2 and 9 for detail). Pull rod 20 is operably connected to a shuttle valve 26 in the lower portion of separator bowl 10, and is described in further detail below. Shuttle valve 26 is proximate an opening in the lower end of separator bowl 10, and may be opened and closed via pull rod 20. A shuttle valve actuator 27 is located above the separator housing, and is operably connected to pull rod 20, using compressed gas or hydraulic fluid to raise and lower pull rod 20, thereby opening and closing shuttle valve 26. Shuttle valve actuator 27 may use a pressure from a fluid, such as air, water, or hydraulic oil, that is injected into shuttle valve actuator 27 to move a piston 25. Piston 25 is operably attached to pull rod 20 to move shuttle valve 26. The actuator piston 25 on the left side of central vertical axis 13 is shown as lowered, thereby lowering shuttle valve 26. The actuator piston 25 on the right side of central vertical axis 13 is shown raised, thereby raising shuttle valve 26.

Also shown in FIG. 1 is a centrate port 28 for removing clarified centrate created by the centrifugation of the feed liquid. Centrate port 28 is in liquid communication with a centrate tube 30 that surrounds and extends along the exterior length of feed tube 24 (see FIGS. 2 and 9 for detail). Centrate port 28 is in liquid communication with the interior of separator bowl 10 via a centrate passage 29 in core tube assembly 16, allowing centrate to be withdrawn from the spinning separator bowl during separation mode, as further discussed below.

Figure 2:
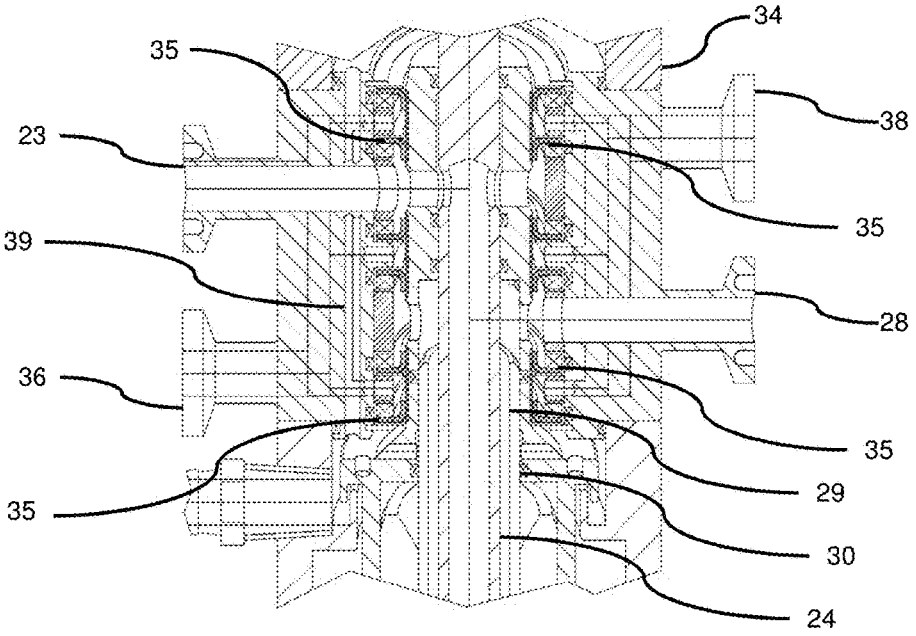
FIG. 2 is a detailed section view of a seal assembly of the centrifugal separator.

The centrifugal separator also includes a main shaft 32 on the upper portion of cylindrical separator bowl 10. A seal assembly 34 for main shaft 32 is also shown in FIG. 1. Seal assembly 34 allows fluid communication of the feed port 23 and centrate port 28 along main shaft 32, while allowing main shaft 32 to spin. A detailed section view of seal assembly 34 is shown in FIG. 2 (FIG. 9, discussed below, provides an alternate embodiment of the seal assembly). The seal assembly 34 in FIG. 2 includes high speed lip seals 35, which seal the exterior of main shaft 32 as it rotates with separator bowl 10. Lip seals 35 are cooled by liquid circulated by a seal cooling input port 36 and a seal cooling output port 38 through cooling line 39. Importantly, the lip seals 35 in seal assembly 34 are easily removed, inspected, and/or replaced, as seal assembly 34 is accessible outside of separator housing 14.

Figure 9:
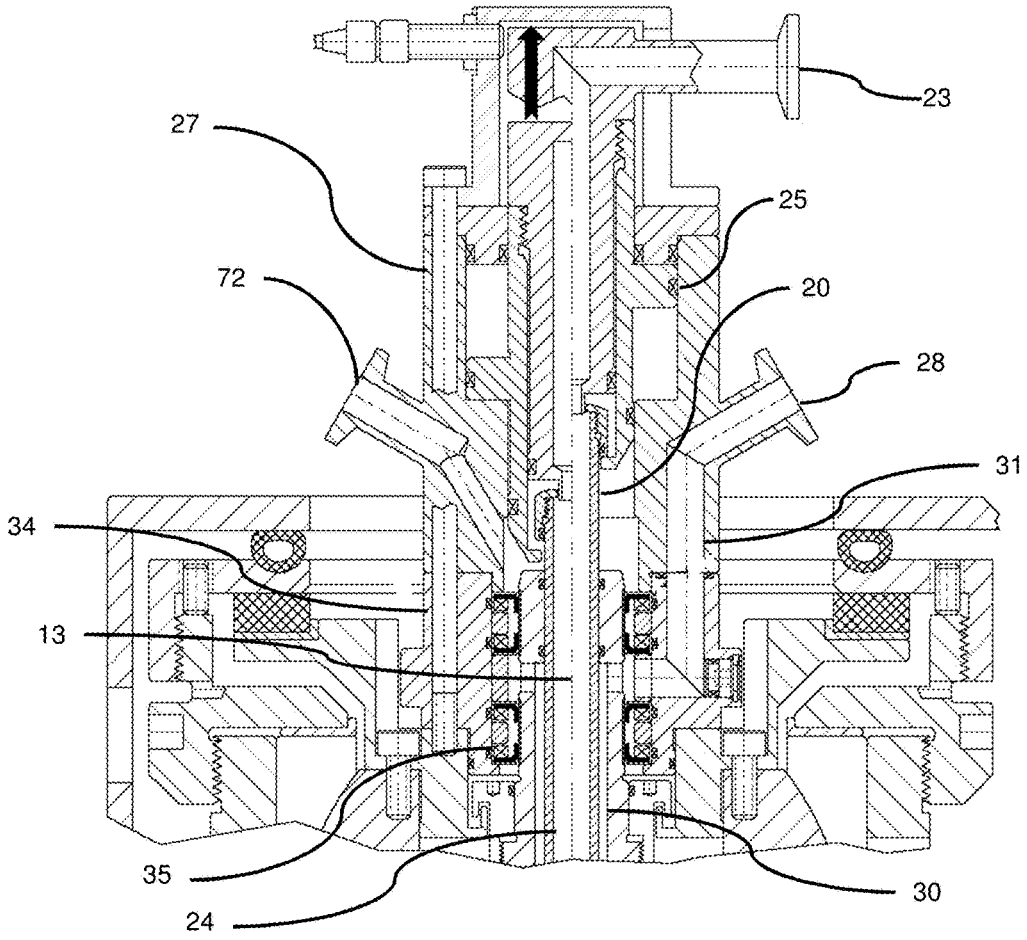
FIG. 9 is a detailed section view of another embodiment of a seal assembly, shuttle valve actuator, and feed port of the centrifugal separator.

FIGS. 2 and 9 also provide a detailed view of the configuration of feed tube 24 and a centrate tube 30. The outer diameter of feed tube 24 and the inner diameter of centrate tube 30 define a centrate passage 29, through which centrate passes and exits from centrate port 28 during separation mode of the centrifugal separator.

Returning to FIG. 1, main shaft 32 operatively connects to a spherically mounted bearing and spindle assembly 40. A variable speed drive motor 42 is connected to a drive pulley 44 by a drive belt 43. The drive motor 42 is controllably operated to rotate the separator bowl 10 at desired speeds for separating the feed liquid. Separators described herein can also be operated using other conventional motor and drive systems. Preferably, the bearing and spindle assembly 40 can comprise a semi-spherical portion 45 and a short cylindrical spindle portion 46, although other suitable assembly configurations could be used in accordance with the centrifugal separator. Bearing and spindle assembly 40 is sealed against main shaft 32 by shaft seal 33.

In one embodiment, the semi-spherical portion 45 comprises an upper semi-hemispherical portion and a lower semi-hemispherical portion. Optionally, the semi-spherical portion 45 can rest against mating surfaces of one or more seats. Since the bearing and spindle assembly 40 is a single piece, the alignment with short cylindrical spindle portion is improved. Exemplary bearing and spindle assemblies with semi-spherical portions that can be employed in a separator of the invention are described by U.S. Pat. Nos. 6,986,734 and 7,618,361, each of which are hereby incorporated by reference herein.

FIG. 1 also shows a discharge case 50 and a discharge gas port 52, as well as an isolation valve 54. The upper end of separator bowl 10 includes gas passages 56 in gas communication with the inside of separator bowl 10 and the top surface of annular piston 18. The isolation valve 54 is open as the feed liquid enters the bowl 10 in fill mode and in feed mode, allowing gas (e.g. air) displaced by upward movement of annular piston 18 to pass between the discharge case 50 and central region 11. When closed, such as during solids discharge mode, the isolation valve 54 prevents gas from moving between discharge case 50 and central region 11, creating a closed system in discharge case 50. Compressed gas (e.g. air) from discharge gas port 52 may then be injected into discharge case 50 to force annular piston 18 downward. In some embodiments, discharge gas port 52 may also include a clean-in-place port to allow cleaning of discharge case 50 and shaft seal 33. The isolation valve 54 on the left side of central vertical axis 13 is shown as open, and the isolation valve 54 on the right side of central vertical axis 13 is shown as closed against lip 53 of separator bowl 10. The isolation valve 54 can comprise an annular member, preferably disposed thereabout, and may be urged upward or downward by compressed fluid, such as compressed gas or hydraulic liquid, that acts against a piston or diaphragm in isolation valve 54.

As shown in FIG. 1, annular solids discharge piston 18 surrounds core tube assembly 16 and is able to slide along the length of core tube assembly 16 and separator bowl 10. In FIG. 1, the drawing on the left side of the central vertical axis 13 shows the annular solids discharge piston 18 positioned at the top of separator bowl 10, and the drawing on the right side of the central vertical axis 13 shows annular solids discharge piston 18 positioned at the bottom of separator bowl 10. Annular solids discharge piston 18 is forced downward during the solids discharge phase using gas pressure (e.g. air), as further described below. The tight clearance between annular solids discharge piston 18, separator bowl 10, and outer diameter of core tube assembly 16 ensures that minimal solids are retained in separator bowl 10 following completion of the solids discharge phase of operation. As annular piston 18 is urged down separator bowl 10, solids are discharged through the opening at the lower end of bowl 10 and into a solids discharge area 58. Solids discharge area includes a discharge clean-in-place port 59 for cleaning the solids discharge area following solids extrusion.

Figure 3:
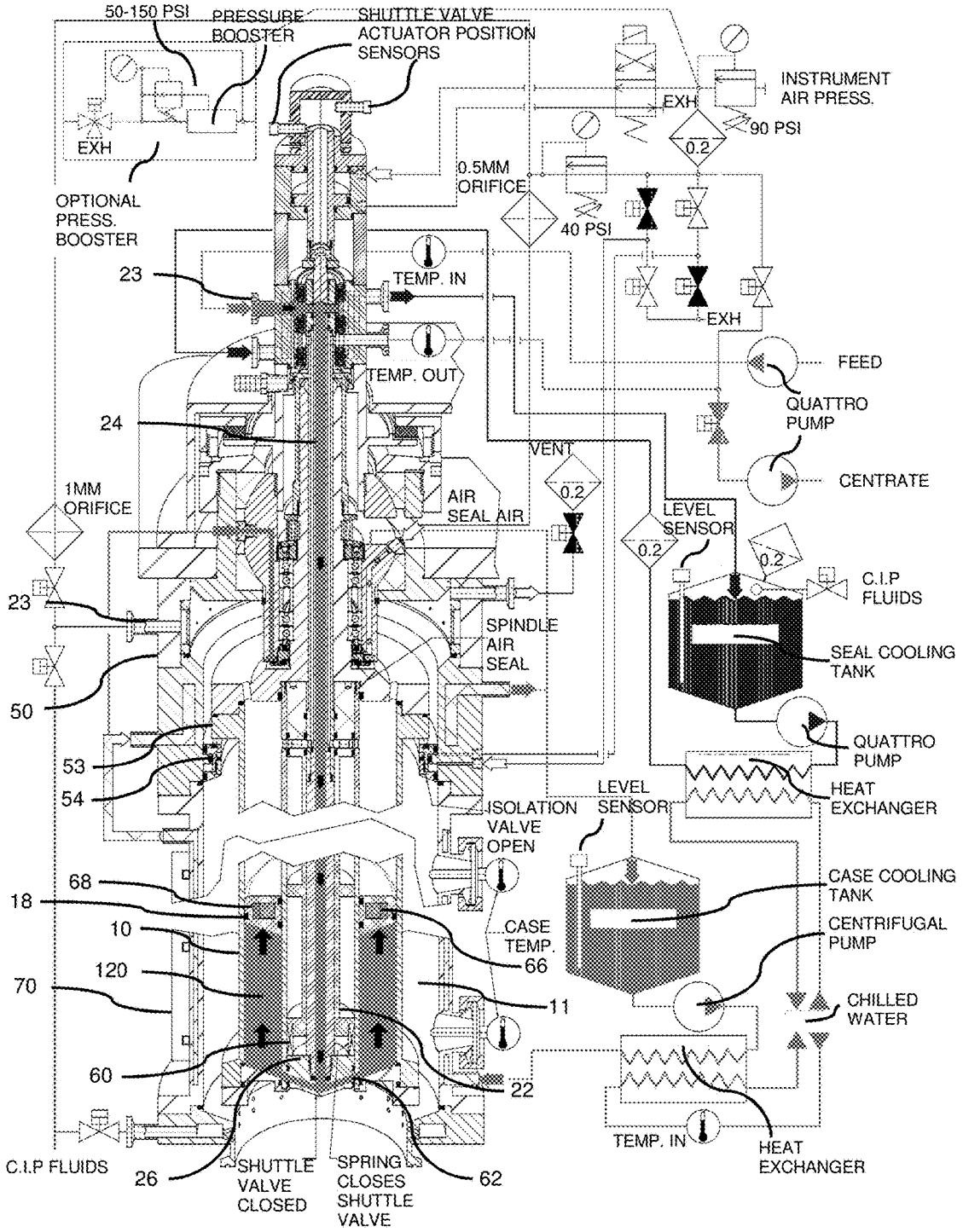
FIG. 3 is a section view of the centrifugal separator of FIG. 1 illustrating operation in a feed mode.

A bowl fill mode of operation of centrifugal separator is described with reference to FIG. 3. Separator bowl 10 is not spinning, as it is being filled with feed liquid or buffer liquid. The isolation valve 54 is open, positioned away from lip 53 of separator bowl 10, allowing gas (e.g. air) to pass between the discharge case 50 and central region 11. Shuttle valve 26 is urged into a closed position within the opening in the lower end of the separator bowl 10 by pressure provided by spring 60 against pull rod support 22, thereby preventing feed liquid from exiting the opening in the bottom separator bowl 10. Feed liquid or buffer 120 is introduced through feed port 23 and down through feed tube 24, exiting into the lower end of separator bowl 10 through feed acceleration channels 62 of shuttle valve 26. The feed acceleration channels 62 are angled slightly upward, at the same angle as the lower end of separator bowl 10, to create angular acceleration of feed liquid as it enters separation bowl 10.

At the beginning of the bowl fill mode, annular piston 18 is positioned at the bottom of separator bowl 10. As feed liquid or buffer liquid 120 is introduced into separator bowl 10, the increasing volume of feed liquid 120 inside separator bowl 10 urges annular piston 18 upward, minimizing air contact with the feed liquid. This lack of air/liquid interface reduces foaming and oxidation of the feed liquid and thus ensuring the solids in the feed liquid are better preserved during the separation process. In some embodiments, the annular piston 18 may include one or more seals in sealing contact with one or both of the inner surface of separator bowl 10 and the outer surface of core tube assembly 16, preventing liquid from moving past annular piston 18. In some embodiments, the annular piston 18 may include a rounded corner between the lower surface of the annular piston 18, and an inner surface of annular piston 18 that is contact with the outer surface of core tube assembly 16. When annular piston 18 is at the lower conical end 17 of separator bowl 10, the rounded corner is proximate the inner surface of lower conical end 17 and slots in the core tube assembly. The rounded corner of the annular piston allows feed liquid that exits core tube assembly 16 to move between the lower surface of annular piston 18 and the inner surface of the lower conical end 17 of separator bowl 10. In some embodiments, lower conical end 17 includes a rounded corner between an inner surface of lower conical end 17 and a surface that mates with the outer surface of core tube assembly 16. In some embodiments, the rounded corner of lower conical end 17 may be proximate a rounded corner of the annular piston 18.

Annular solids discharge piston 18 includes an annular neodymium magnet 66 used for position sensing of annular piston 18 during solids discharge. The position of annular piston 18 may be detected by an array of magnetic switches 70, such as reed switches, positioned linearly and vertically on separator housing 13 (see also FIG. 3 and description below). Neodymium magnet 66 may be surrounded by a support ring 68 that provides structural support to neodymium magnet 66 during the feed liquid mode, as the annular piston 18 experiences high centrifugal force during the liquid feed mode.

In some embodiments, a flow meter may be used with the feed port 23, feed tube 24, or a line leading into feed port 23 (not shown) to measure the appropriate amount of feed liquid or buffer liquid. Pumps used for introducing feed liquid, for removing centrate (see description below), and for discharging solids via the annular piston may be peristaltic or quattro type pumps to further minimize shear on the feed and centrate liquids.

Figure 4:
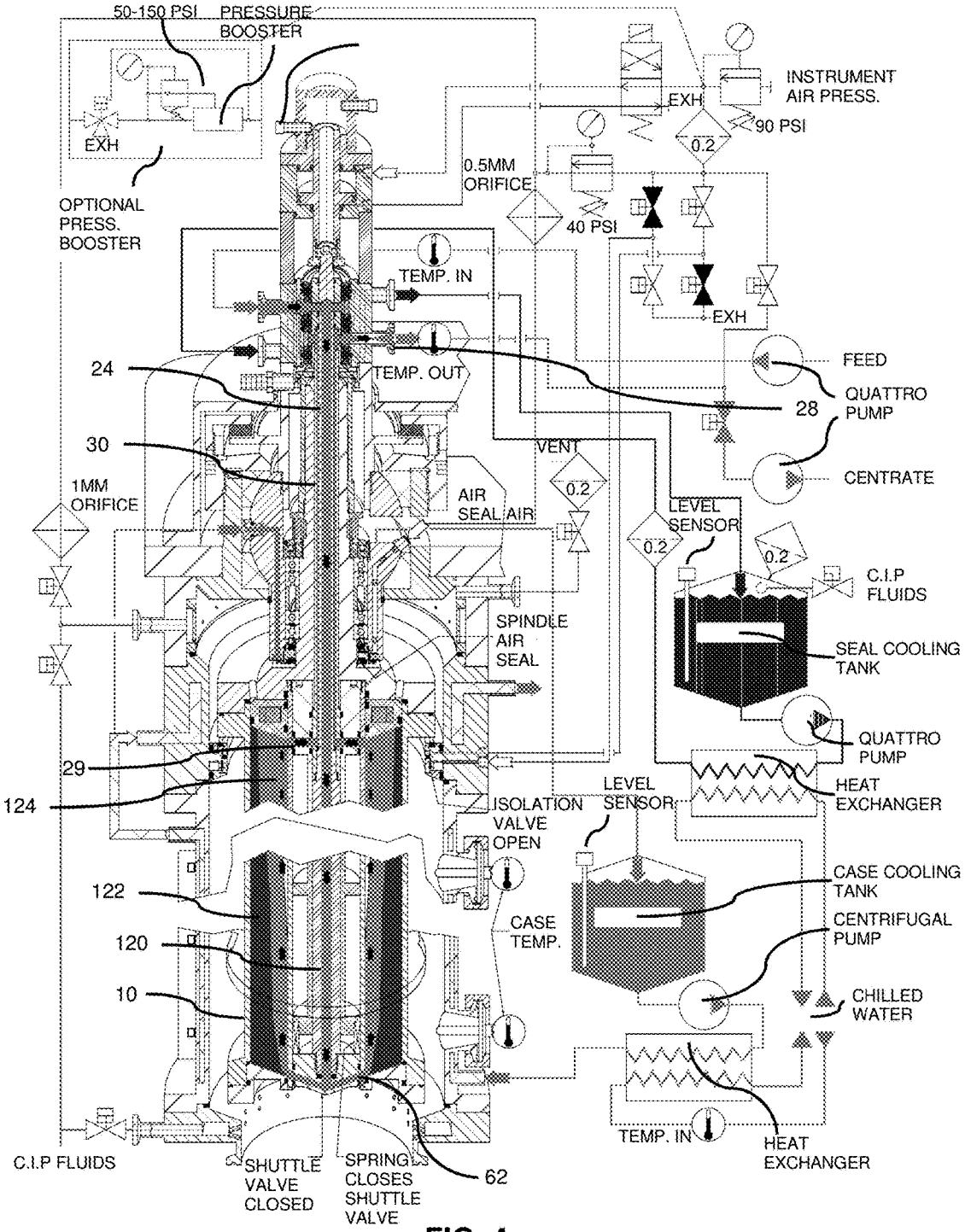
FIG. 4 is a section view of the centrifugal separator of FIG. 1 illustrating operation in liquid/solid separation mode.

FIG. 4 shows the centrifugal separator during separation mode. Separator bowl 10 is spinning at high speed to separate solid particles suspended in the feed liquid. As feed liquid 120 exits feed acceleration channels 62 into separator bowl 10, Coriolis acceleration effects tracks the feed liquid 120 along the outer diameter of core tube assembly 16 to the top of separator bowl 10 and into centrate passage 29. The centrate 124 continues up centrate tube 30 surrounding feed tube 24, and out of the centrifugal separator via centrate port 28. Separated solids 122 collect on the inner diameter of separator bowl 10, packing into a cake with paste-like consistency. As centrate is removed, additional feed liquid is introduced to separator bowl 10 via feed tube 24. The sedimentation of feed liquid may continue until the desired bowl volume of solids is reached (e.g., 25% to 98% of bowl volume filled with solids).

In some embodiments, a bubble sensor (not shown) may be used on a centrate output line connected to centrate port 28 to detect when separator bowl is full. In some embodiments, a centrate turbidity meter (not shown) may be used to monitor the turbidity of the centrate leaving separator bowl 10; a nearly full bowl is indicated by a sudden rise in turbidity of the centrate. In some embodiments, a specified volume of feed liquid may be programmed with a feed flow meter (not shown), which is known to result in a desired volume of solids by using spin-test data. In some embodiments, the tank holding the feed liquid can be weighed during separation mode. A given weight of feed liquid injected into the centrifugal separator can be correlated with a desired volume of solids in the separator bowl, and the feed liquid can be stopped once a given weight of feed liquid has been used.

Figure 5:
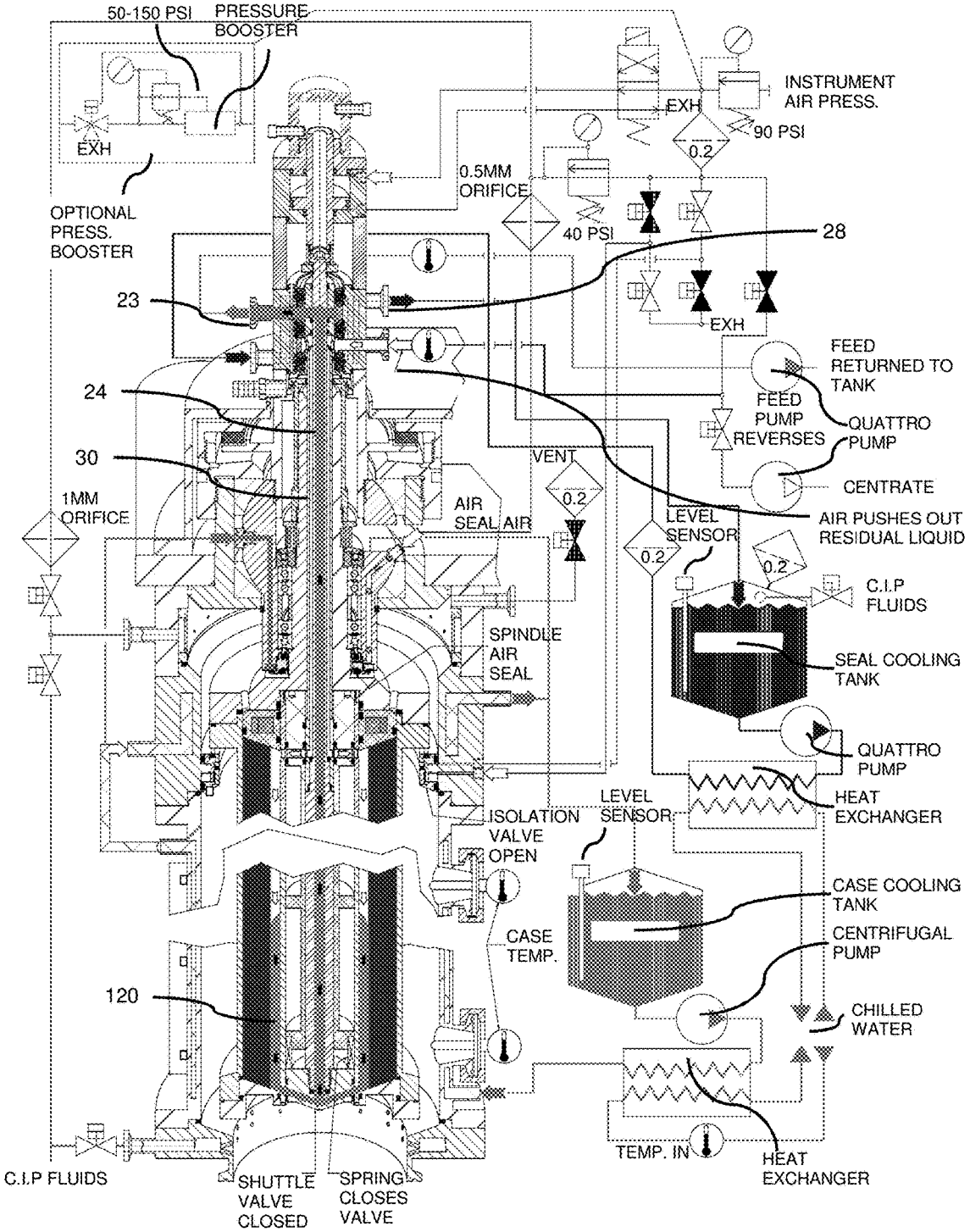
FIG. 5 is a section view of the centrifugal separator of FIG. 1 illustrating operation when residual liquid drains from the bowl.

FIG. 5 shows the centrifugal separator in bowl drain mode, with the separator bowl no longer spinning. Residual feed liquid 120 is pumped back up feed tube 24 and out of feed port 23, and may be channeled to a reservoir or container separate from the source of feed liquid. Gas (e.g. air) may be pumped back into centrate port 28 through centrate tube 30 into separator bowl 10 via peristaltic or quattro type pumps to assist the removal of excess feed liquid 120.

Figure 6:
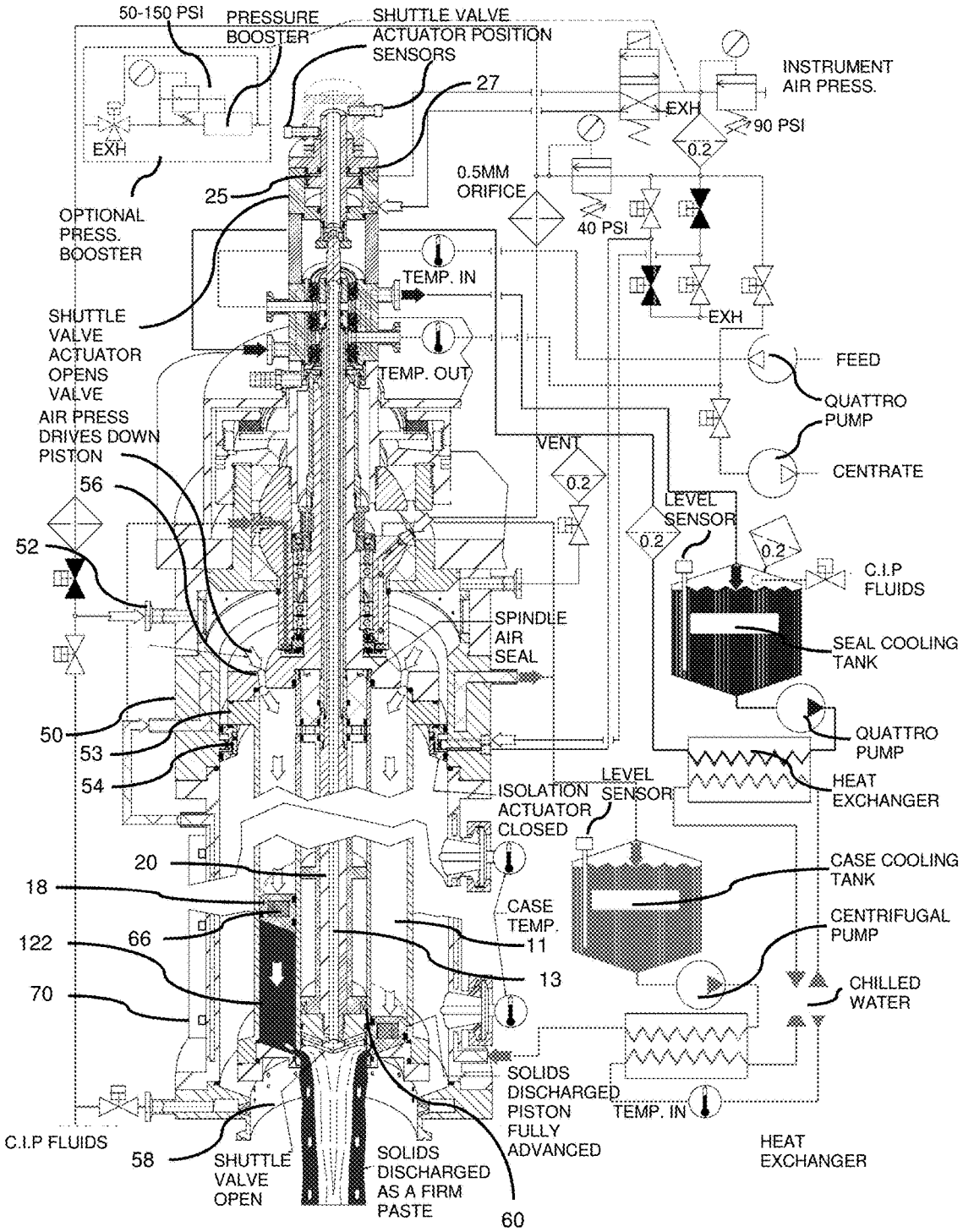
FIG. 6 is a section view of the centrifugal separator of FIG. 1 illustrating operation in a solids discharge mode.

FIG. 6 shows the centrifugal separator in solids discharge mode. Shuttle valve actuator 27 is actuated to raise actuator piston 25, moving pull rod 20 upward, thereby opening shuttle valve 26, while compressing spring 60. The opening of shuttle valve 26 exposes slots in the core tube assembly (shown in detail in FIG. 7; see discussion below). The slots allow solids to pass from separator bowl 10 out of the opening in the lower conical end 17. In some embodiments, shuttle valve 26 is not removed completely from the opening in the lower end of separator bowl 10, when in an opened position. In such embodiments, shuttle valve 26 may include slots that are exposed to the inside of separator bowl 10 after being partially removed from the opening in the lower end of separator bowl 10 (not shown; see FIG. 7 and discussion below). The slots extend through shuttle valve 26, and are in communication with slots in core tube assembly 16, providing a passage for solids to be extruded from the inside of separator bowl 10 through the bottom of separator bowl 10.

During solids discharge mode, isolation valve 54 is closed against lip 53 of separator bowl 10, preventing passage of gas or air between discharge case 50 and central region 11. This creates an air-tight closed system between discharge port 52, gas passages 56 in the upper end of separator bowl 10, and the top surface of annular piston 18. Gas (e.g. air) pumped into discharge port 56 urges annular piston 18 downward. In FIG. 6, the drawing on the left side of the central vertical axis 13 shows the annular solids discharge piston 18 positioned part of the way down the length of separator bowl 10. The drawing on the right side of the central vertical axis 13 shows annular solids discharge piston 18 at the bottom of separator bowl 10. As discussed above, in some embodiments, the position of annular piston 18 may be determined using an array of magnetic switches 70, e.g. reed switches, on separator case 10 that are activated by annular neodymium magnet 66 inside annular piston 18. As annular piston 18 moves downward through bowl 10, accumulated solids 122 are extruded out of the opening in the lower end of separator bowl and into discharge area 58. The accumulated solids 122 may be captured in a reservoir or tank below solids discharge area 58. Once the annular piston 18 has reached the bottom of its stroke, shuttle valve 26 is closed using shuttle activator 27 and/or spring 60, by lowering shuttle valve 26 into the opening in the lower end of separator bowl 10. The process of closing shuttle valve 26 covers the slots in core tube assembly 16 with the outer surface of shuttle valve 26, and thereby severs any remaining tube of accumulated solids paste hanging from the opening in the lower conical end 17 of separator bowl 10.

Figure 7:
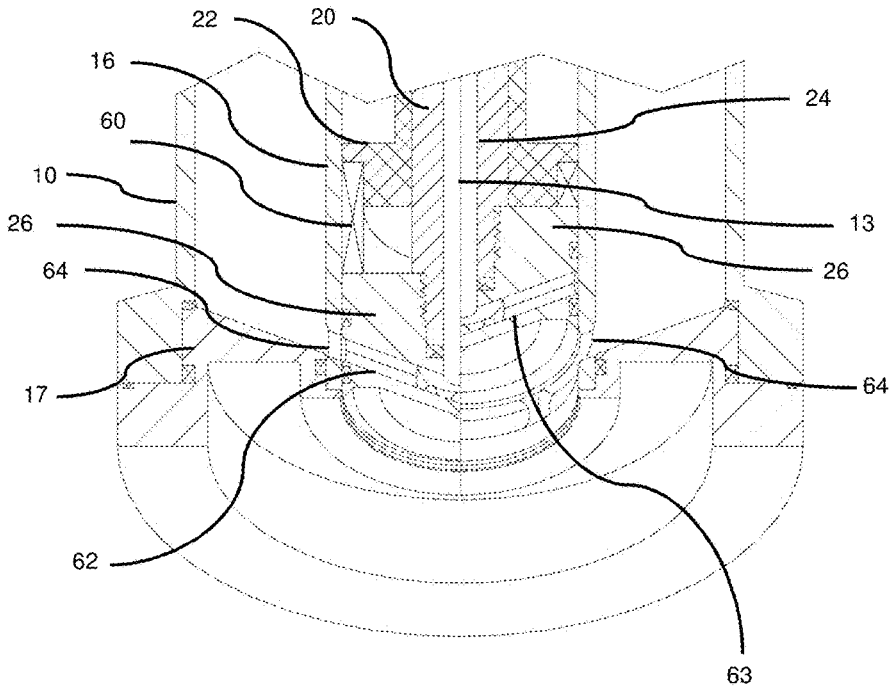
FIG. 7 is a detailed section view of the lower bowl, annular solids discharge piston, and shuttle valve of FIG. 1.

FIG. 7 shows a close up partial section view of the lower end of separator bowl 10 and an embodiment of shuttle valve 26. In FIG. 7, the drawing on the left side of central vertical axis 13 shows shuttle valve 26 in a closed position, sealing the opening in the lower end 17 of separator bowl 10. The drawing on the right side of central vertical axis 13 shows shuttle valve 26 raised in an open position to allow solids extrusion. Turning to the left side of FIG. 7, shuttle valve 26 is forced down into a closed position by spring 60 pressing against pull rod support 22. Preferably, spring 60 is a multi-layer wave spring, although other types of springs may be used. During feed liquid mode, feed liquid is pumped down feed tube 24 and through feed acceleration channels 62 and out of slots 64 in core tube assembly 16, thereby entering separator bowl 10. Turning to the right side of FIG. 7, during solids discharge mode, pull rod 20 is actuated upward, raising shuttle valve 26 and compressing spring 60 (see right side of drawing in FIG. 7). When shuttle valve 26 is opened, feed acceleration channels 62 are covered by the interior surface of core tube assembly 16, and slots 64 in the core tube assembly 16 are exposed. As the annular piston 18 travels downward, solids are extruded through slots 64 to exit the opening in the lower conical end 17 of separator bowl 10 that is partially filled by shuttle valve 26.

Figure 8:
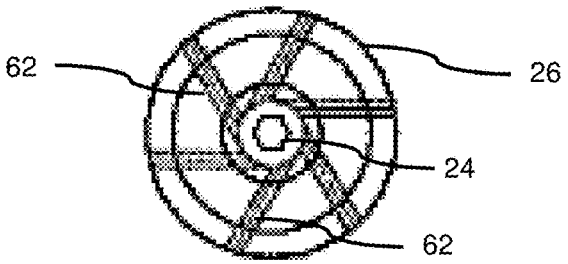
FIG. 8 is a detailed plan section view of the shuttle valve of FIG. 1 showing the feed acceleration channels.

FIG. 8 shows a plan section view of feed acceleration channels 62 in shuttle valve 26. Feed acceleration channels 62 extend radially and at an angle relative to the center of feed tube 24. Both the relative angle at which the feed acceleration channels 62 extend radially from feed tube 24, as well as the upward angle of feed acceleration channels 62 (see FIG. 1 and discussion above), contribute to the angular acceleration of feed liquid as it enters separation bowl.

FIG. 9 shows a detailed section view of an alternative embodiment of a seal assembly, shuttle valve actuator, and feed port of the centrifugal separator. Feed liquid port 23 is positioned above seal assembly 34, and is in liquid communication with feed tube 24 running down through seal assembly 34, instead of entering the side of seal assembly 34 as shown in FIG. 2. Seal clean-in-place port 72 is also located above seal assembly 34. Centrate port 28 is located above seal assembly 34, and is in liquid communication with centrate tube 30 via centrate exit passage 31. This configuration allows for fewer high speed lip seals 35 to be used in seal assembly 34 (only four, as compared to six in FIG. 2).

Shuttle valve actuator 27 is positioned above seal assembly 34, and has feed tube 24 running through it. In FIG. 9, actuator piston 25 on the left side of central vertical axis 13 is shown as lowered, thereby lowering shuttle valve 26 via pull rod 20. The actuator piston 25 on the right side of central vertical axis 13 is shown raised, thereby raising shuttle valve 26 via pull rod 20.

In some embodiments, one or both of feed liquid port 23 and feed tube 24 may include a circumferential lip or a decrease in diameter on its inner surface. Such a circumferential lip or decrease in diameter can minimize pumping effects on the feed liquid as it is pumped down the feed tube, and helping prevent the feed liquid from moving back up the feed tube as it is being injected during the separation phase.

While the present invention has been described in conjunction with a preferred embodiment, one of ordinary skill in the art, after reading the foregoing specification, will be able to effect various changes, substitutions of equivalents and other alterations to the compositions, articles, methods and apparatuses set forth herein. For example, fluid pressure may be replaced in other embodiments by, without limitation, an electromechanical force. Similarly, the lower portion and end of the piston and bowl, respectively, may not be conical in shape, although it is preferable for solids recovery that their shapes be complimentary.

Moreover, the invention also contemplates that the various passages, valves, pistons, actuators, assemblies, ports, members and the like described herein can be in any configuration or arrangement that would be suitable for operation of a centrifugal separator. The embodiments described above may also each include or incorporate any of the variations of all other embodiments. It is therefore intended that the protection granted by Letter Patent hereon be limited only by the definitions contained in the appended claims and equivalents thereof.

What is claimed:

1. A centrifugal separator comprising:

a separator housing, the separator housing having a main body portion;

a cylindrical separator bowl disposed in the main body portion of the separator housing, the cylindrical separator bowl having an upper end, and a lower end with an opening, the cylindrical separator bowl being operative during a separation mode of operation to rotate at a high speed to separate feed liquid into centrate and solids, wherein solids accumulate along an inner surface of the cylindrical separator bowl;

a core tube assembly disposed axially along the interior length of the cylindrical separator bowl, the core tube assembly comprising a pull rod operative for axial movement along the core tube assembly, the pull rod comprising a feed tube along an interior length of the core tube assembly, and a shuttle valve operatively coupled to the pull rod, wherein the shuttle valve is operative for axial movement to open and close the opening in the lower end of the cylindrical separator bowl, the shuttle valve comprising feed acceleration channels in fluid communication with the feed tube;

an actuator at the upper end of the core tube assembly, the actuator operatively coupled to the pull rod to move the shuttle valve;

an annular piston disposed between an inner surface of the cylindrical separator bowl and an outer surface of the core tube assembly, the annular piston being operative for axial movement to discharge solids out of the opening in the lower end of the cylindrical separator bowl; and a gas port in gas communication with an upper surface of the annular piston via at least one gas passage in the upper end of the cylindrical separator bowl, wherein gas introduced through the gas port presses against the upper surface of the annular piston to drive the annular piston downward and discharge solids through the opening in the lower end of the cylindrical separator bowl, wherein feed liquid selectively introduced through the feed tube and the feed acceleration channels enters the cylindrical separator bowl, outside the core tube assembly, when the shuttle valve has closed the opening in the lower end of the cylindrical separator bowl, and wherein the solids accumulate on the inner surface of the cylindrical separator bowl through selective centrifugation of the feed liquid within the cylindrical separator bowl.

2. The centrifugal separator of claim 1, wherein the core tube assembly comprises at least one slot, wherein solids are extruded out of the opening in the lower end of the cylindrical separator bowl through the at least one slot by the annular piston when a lower portion of the shuttle valve is positioned outside of the opening in the lower end of the cylindrical separator bowl, the opening in the lower end of the cylindrical separator bowl being opened thereby.

3. The centrifugal separator of claim 1, wherein the core tube assembly comprises at least one spring disposed between the shuttle valve and a lower portion of the core tube assembly, the at least one spring urging the shuttle valve into the opening in the lower end of the cylindrical separator bowl to thereby close the opening.

4. The centrifugal separator of claim 1, wherein the annular piston comprises at least one magnet, and the separator housing comprises an array of magnetic switches for detecting the position of the annular piston through selective interaction with the at least one magnet of the annular piston.

5. The centrifugal separator of claim 1, wherein the core tube assembly comprises an opening in liquid communication with a centrate passage, wherein the centrate passage is defined by an inner surface of the core tube assembly and an outer surface of the feed tube, and wherein the centrate passage is in fluid communication with a centrate port, thereby allowing removal of centrate from the cylindrical separator bowl.

6. The centrifugal separator of claim 1, comprising an isolation valve disposed proximate a passage defined by an inner surface of the separator housing and an outer surface of the cylindrical separator bowl, the isolation valve to open and close the passage defined by the inner surface of the separator housing and the outer surface of the cylindrical separator bowl.

7. The centrifugal separator of claim 1, wherein the lower end of the cylindrical separator bowl and a lower portion of the annular piston are complementarily shaped.

8. The centrifugal separator of claim 1, wherein the lower end of the cylindrical separator bowl and a lower portion of the annular piston are substantially frustoconically shaped.

9. A method for discharging solids from a centrifugal separator, comprising:

providing a centrifugal separator comprising a separator housing, the separator housing having a main body portion, a cylindrical separator bowl disposed in the main body portion of the separator housing, the cylindrical separator bowl having an upper end, and a lower end with an opening, a core tube assembly disposed axially along the interior length of the cylindrical separator bowl, the core tube assembly comprising a pull rod operative for axial movement along the core tube assembly, the pull rod comprising a feed tube along an interior length of the core tube assembly, and a shuttle valve operatively coupled to the pull rod, wherein the shuttle valve is operative for axial movement to open and close the opening in the lower end of the cylindrical separator bowl, the shuttle valve comprising feed acceleration channels in fluid communication with the feed tube, an actuator at the upper end of the core tube assembly, the actuator operatively coupled to the pull rod to move the shuttle valve into and out of the opening;

an annular piston disposed between an inner surface of the cylindrical separator bowl and an outer surface of the core tube assembly, the annular piston being operative for axial movement to discharge solids out of the opening in the lower end of the cylindrical separator bowl; and a gas port in gas communication with an upper surface of the annular piston via at least one gas passage in the upper end of the cylindrical separator bowl;

selectively introducing feed liquid into the cylindrical separator bowl, outside the core tube assembly, through the feed tube and the feed acceleration channels when the shuttle valve has closed the opening in the lower end of the cylindrical separator bowl, selectively rotating the cylindrical separator bowl at high speed to separate the feed liquid into centrate and solids and accumulating solids on the inner surface of the cylindrical separator bowl; and introducing gas through the gas port to press against the upper surface of the annular piston to drive the annular piston downward and discharge the accumulated solids through the opening in the lower end of the cylindrical separator bowl.

10. The method of claim 9, further comprising closing an isolation valve before introducing the gas through the gas port, wherein the isolation valve is disposed proximate a passage defined by an inner surface of the separator housing and an outer surface of the cylindrical separator bowl.

11. The method of claim 9, further comprising opening the shuttle valve before introducing the gas through the gas port, wherein opening the shuttle valve is accomplished by actuating the actuator to move the shuttle valve within the opening to expose at least one slot in the core tube assembly.

12. The method of claim 11, further comprising closing the shuttle valve after the annular piston has reached the lower end of the cylindrical separator bowl, wherein closing the shuttle valve is accomplished by activating the actuator to move the shuttle valve within the opening, thereby covering the at least one slot in the core tube assembly.

13. The method of claim 9, wherein the core tube assembly comprises an opening in liquid communication with a centrate passage, wherein the centrate passage is defined by an inner surface of the core tube assembly and an outer surface of the feed tube, and wherein the centrate passage is in fluid communication with a centrate port, thereby allowing removal of centrate from the cylindrical separator bowl.

14. The method of claim 13, wherein the inner surface of the core tube assembly comprises a centrate tube.

* * * * *